US006691658B2

(12) United States Patent
Fujita et al.

(10) Patent No.: US 6,691,658 B2
(45) Date of Patent: Feb. 17, 2004

(54) ROTATION PREVENTION STRUCTURE OF A VALVE LIFTER FOR AN INTERNAL COMBUSTION ENGINE

(75) Inventors: Hideo Fujita, Iwata (JP); Shigenobu Uchiyama, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 10/064,404

(22) Filed: Jul. 10, 2002

(65) Prior Publication Data

US 2003/0010298 A1 Jan. 16, 2003

(30) Foreign Application Priority Data

Jul. 12, 2001 (JP) ..... 2001-211759

(51) Int. Cl.[7] ..... F01L 1/14
(52) U.S. Cl. ..... 123/90.5; 123/90.48
(58) Field of Search ..... 123/90.48, 90.49, 123/90.5

(56) References Cited

U.S. PATENT DOCUMENTS 3,139,076 A * 6/1964 Flaherty ..... 123/90.5
4,448,155 A * 5/1984 Hillebrand et al. ..... 123/90.5
5,178,107 A * 1/1993 Morel et al. ..... 123/90.35
5,454,353 A * 10/1995 Elendt et al. ..... 123/90.16
5,651,335 A * 7/1997 Elendt et al. ..... 123/90.16
6,244,229 B1 6/2001 Nakano et al.
6,427,652 B2 * 8/2002 Faria et al. ..... 123/90.16

FOREIGN PATENT DOCUMENTS

DE 41 15 670 A1 11/1992
GB 674732 7/1995

OTHER PUBLICATIONS

European Search Report Dated May 30, 2003.

* cited by examiner

*Primary Examiner*—Thomas Denion
*Assistant Examiner*—Jaime Corrigan
(74) *Attorney, Agent, or Firm*—Ernest A Beutler

(57) ABSTRACT

Several embodiments of anti-rotation devices for precluding rotation of the valve actuating lifters or tappet bodies caused by the action of the cam lobe on the engaged surface of the lifter. In each embodiment, the anti-rotation function is achieved without adding to the reciprocating masses of the engine.

13 Claims, 10 Drawing Sheets

ROTATION PREVENTION STRUCTURE OF A VALVE LIFTER FOR AN INTERNAL COMBUSTION ENGINE

BACKGROUND OF INVENTION

This invention relates to a valve actuating structure for operating poppet valves and more particularly to the rotation prevention structure of a valve lifter for an internal combustion engine.

A wide variety of reciprocating machines such an internal combustion engines employ poppet valves that are operated through camshafts via followers in the form of valve lifters such as thimble tappets. These valve lifters are supported for reciprocation in bores formed in an engine body and are operatively interposed between the cam lobes the valve stems.

Conventionally, the valve lifters or tappets are formed as cylindrical bodies having an upper surface engaged by the cam and which has a shape of the arc of a circle when viewed in the direction of the camshaft axis. In a perpendicular plane, the upper surface has a generally linear configuration. Thus, the top surface of the valve lifter engaged by the cam lobe is in the form of a section of a cylinder. However, because of this construction, there is likelihood that the operation of the lifter by the rotation of the cam can also cause rotary motion of the lifter about its reciprocal axis. This can result in undue wear of the lifter and/or receiving body of the engine, which can be detrimental to optimum performance.

It is, therefore, a principal object to this invention to provide an improved structure that serves the function of preventing rotation of the valve lifter upon operation of the valve and due to rotation of the actuating cam.

It is important when considering the valve timing of an engine to minimize the reciprocating masses. As the reciprocating masses increase, the inertia on the entire system increases resulting in the possibility of valve flow and decrease performance. It is, therefore, a still further object to this invention to provide an improved arrangement for precluding rotation of the valve lifter upon its actuation and which is done in a way so as to avoid any increase in the mass of the valve lifter.

SUMMARY OF INVENTION

This invention is adapted to be embodied in a valve lifter arrangement for operating a poppet valve from the rotating can of a camshaft. The construction comprises an engine body defining a cylindrical bore. A valve tappet having a generally cylindrical body portion is supported for reciprocation in the cylindrical bore. The valve tappet has a head portion adapted to be operated by the cam. In accordance with the invention interengaging portions carried by the valve tappet and the engine body permit reciprocation of the valve tappet in the engine body but prevent rotation thereof.

DETAILED DESCRIPTION

Figure 1:
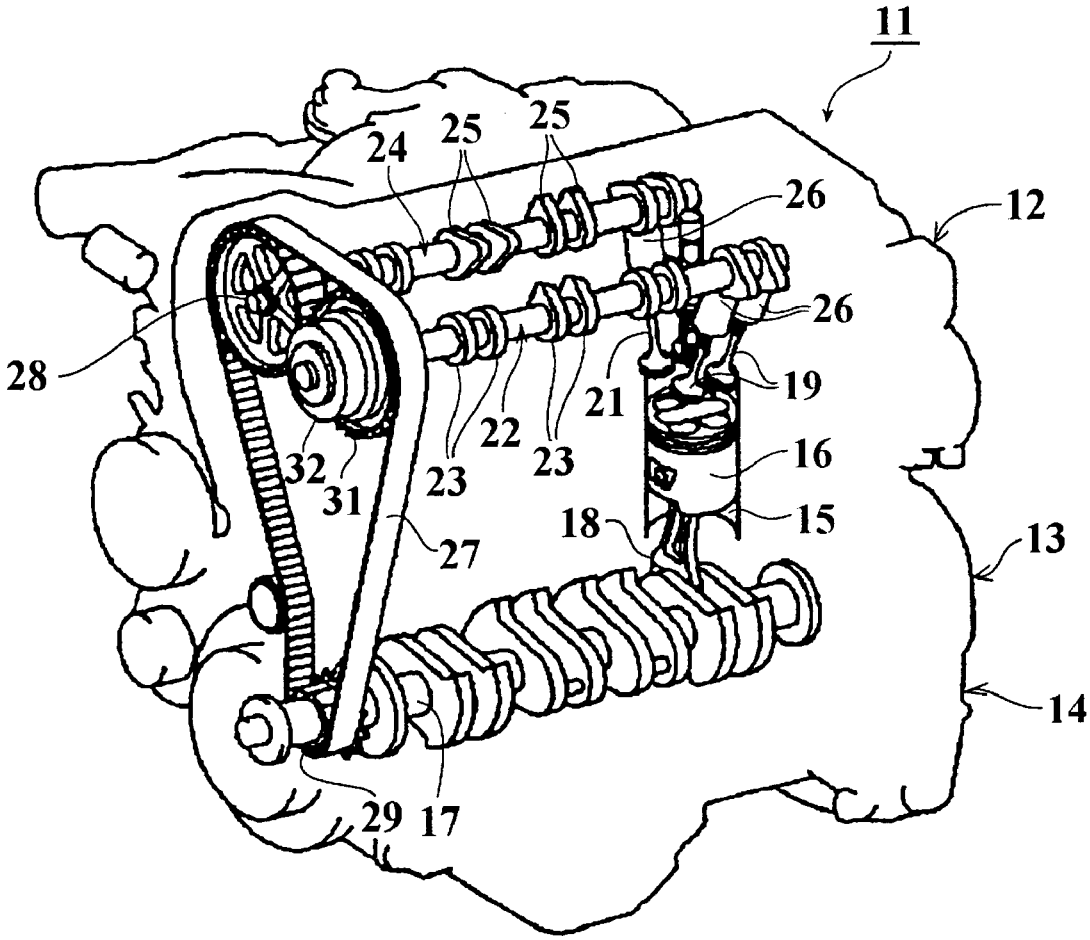
FIG. 1 is a perspective view of an internal combustion engine showing the valve actuating mechanism therefore in solid lines with the outline of the engine being shown in solid lines, but broken away to show the valve operating mechanism.

Referring now in detail to the drawings and initially primarily to FIG. 1, an internal combustion engine constructed in accordance with an embodiment of the invention is shown in part and is identified generally by the reference numeral 11. The engine 11 is comprised of a main engine body that includes a cylinder head assembly 12, a cylinder block assembly 13 and a crankcase forming member 14 that are connected together in any suitable manner.

The cylinder block 13 forms a plurality of cylinder bores 15, which are disposed, in the illustrated embodiment, in an in-line arrangement. Although such an arrangement can be used, the invention can be employed with engines having other cylinder configurations such as V-type or opposed engines, as will become readily apparent to those skilled in the art.

Since the invention deals primarily with the valve actuating mechanism for the engine 11, only those components associated with it are shown in detail in this perspective view. These include pistons 16, only one of which is shown, which reciprocates in the cylinder bores 15 and are connected to drive a crankshaft 17 by means of connecting rods 18 in any well known manner.

In the illustrated embodiment, the engine 11 is of the four valve per cylinder type and each cylinder is provided with a pair of intake valves 19 disposed on one side of a plane containing the cylinder bore axis and a pair of exhaust valves 21 formed on the other side of this plane for each of the cylinder bores 15. The intake and exhaust valves 19 and 21 are of the poppet valve type and are supported for reciprocation in a manner, which will be described later by reference to the remaining figures.

In the illustrated embodiment, the valves 19 and 21 are operated by means of a pair of overhead camshafts consisting of an intake camshaft 22, having intake cam lobes 23, and an exhaust camshaft 24 having exhaust cam lobes 25. The camshafts 22 and 24 are rotatably journalled in a manner, which will be described. Each cam lobe 23 and 25 cooperates with a respective thimble type tappet 26, which is supported for reciprocation in a manner, which will also be described later by reference to the remaining figures.

In the illustrated embodiment, the intake and exhaust camshafts 22 and 24 are driven at one end of the engine 11 by means of a timing drive which, in the illustrated embodiment, comprises a toothed timing belt 27 that cooperates directly with a sprocket 28 that is affixed to the exhaust camshaft 24 and which drives the exhaust camshaft at one-half crankshaft speed from a driving sprocket 29 fixed to this end of the crankshaft 17.

On the other hand, the intake camshaft 22 is driven by a timing sprocket 31, which drives the intake camshaft 22 through a variable valve timing mechanism 32. In this regard, it should be noted that the described valve timing drive is only typical of one of many, which can be utilized in conjunction with the invention. For that reason, a detailed description of the camshaft drive mechanism is not believed to be necessary to permit those skilled in the art to practice the invention. Those skilled in the art can readily apply the invention to any known type of valve drive and valve actuating mechanism that includes cam lobes, which cam lobes operate thimble tappets either directly or through an intermediary method which may be likely to cause rotation of the thimble tappets in their supporting engine structure.

Referring now in detail primarily to FIGS. 2 through 5, a first embodiment of the invention is shown in detail. In this embodiment, the relationship of one of the thimble tappets 26 to a pair of the exhaust valves 21 is described. It is to be understood that the same type of structure is utilized in conjunction with the intake camshaft 22.

Each of the valves, such as the exhaust valves 21, is of the poppet type and includes a valve head 33 which valves a valve seat 34 formed in an appropriate manner in the respective side of the cylinder head. A stem 35 of the valve 21 is slidably supported in directly in the cylinder head member 12 or in a valve guide 36 which is cast, pressed or otherwise positioned therein.

A keeper retainer assembly 37 is fixed to the upper end of the valve stems 35 and is engaged by one end of a valve return spring such as a coil compression spring 38. The other end of the valve spring 38 is engaged with the cylinder head member 12 in a well known manner so as to urge the respective valve 21 to its closed position.

An adjusting shim 39 is interposed between the tip of the valve stems 35 and an undersurface of the head 41 of the thimble tappet 26. The tapped head 41 is formed at the upper end of a cylindrical body portion 42 and which is reciprocally supported in a bore 43 formed in the cylinder head member 12.

Figure 2:
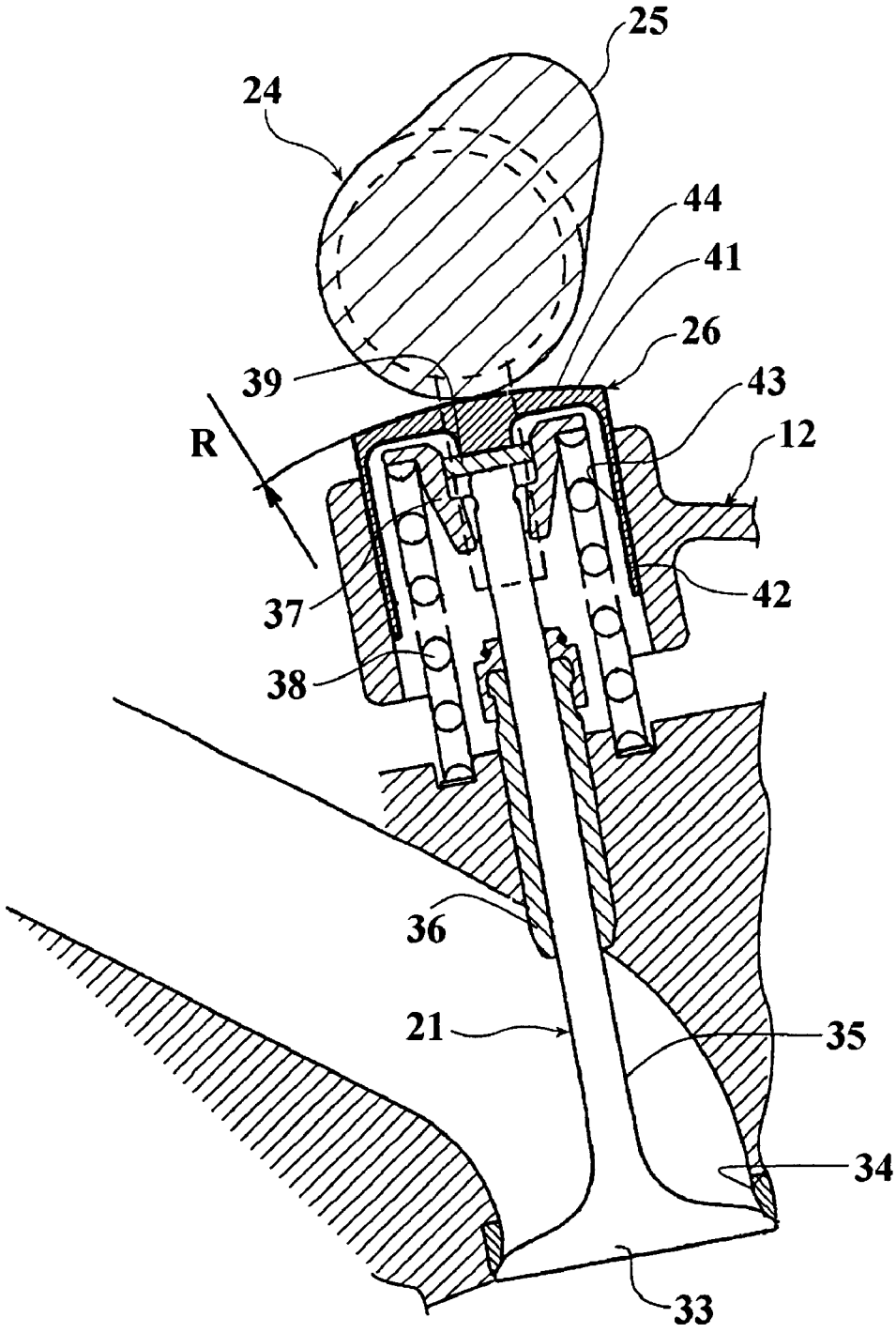
FIG. 2 is an enlarged cross sectional view taken through the axis of reciprocation of the one of the engine valves and is taken along the line 2—2 of FIG. 3.
Figure 3:
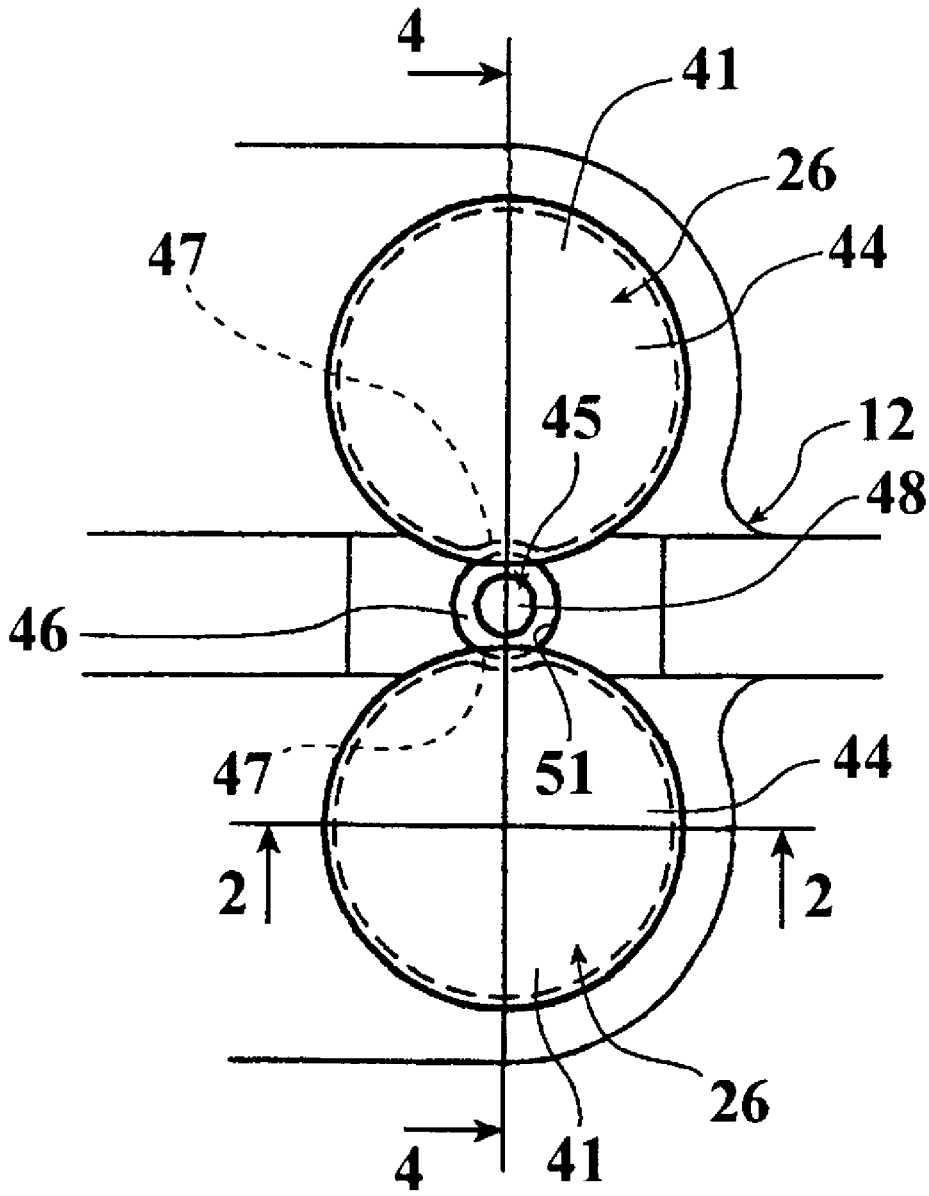
FIG. 3 is a top plan view, looking in a direction perpendicular to the direction of FIG. 2 but with the camshaft removed so as to more clearly show the tappet bodies and the anti-rotation prevention mechanism therefore.

As is typical in this practice, in a plane looking perpendicular to the cylinder bore axis, the tappet head portion 41 is formed with an arcuate curvature 44 that has a radius R (FIG. 2). Viewed in a perpendicular direction (FIG. 4), it will be seen that this curved surface 44 appears as a straight line.

The structure as thus far described may be considered to be conventional and as such, without more, could be subject to the problem of rotation of the thimble tappets 26 in their supporting cylinder head bores 23 which could cause wear of one or both components.

In accordance with the invention, therefore, and in this embodiment, and anti-rotation pin, indicated generally by the reference numeral 45 is provided. This anti-rotation construction pin 45 is, in this embodiment, comprised of a single anti-rotation pin 45 mounted in the cylinder head member 12 between the each of the pairs of tappet bodies associated with both the intake and exhaust valves of each cylinder.

This anti-rotation pin 45 is comprised of a larger diameter headed portion 46 that is engaged in a pair of machined semi-cylindrical recesses 47 formed in each of the adjacent portions of the tappet bodies 26. A smaller diameter portion 48 extends upwardly in the area between the tappet bodies and is engaged at its upper end by a bearing portion 49 of the respective camshaft so as to retain it in the cylinder head 12 in the position shown in FIGS. 4 through 6.

Figure 4:
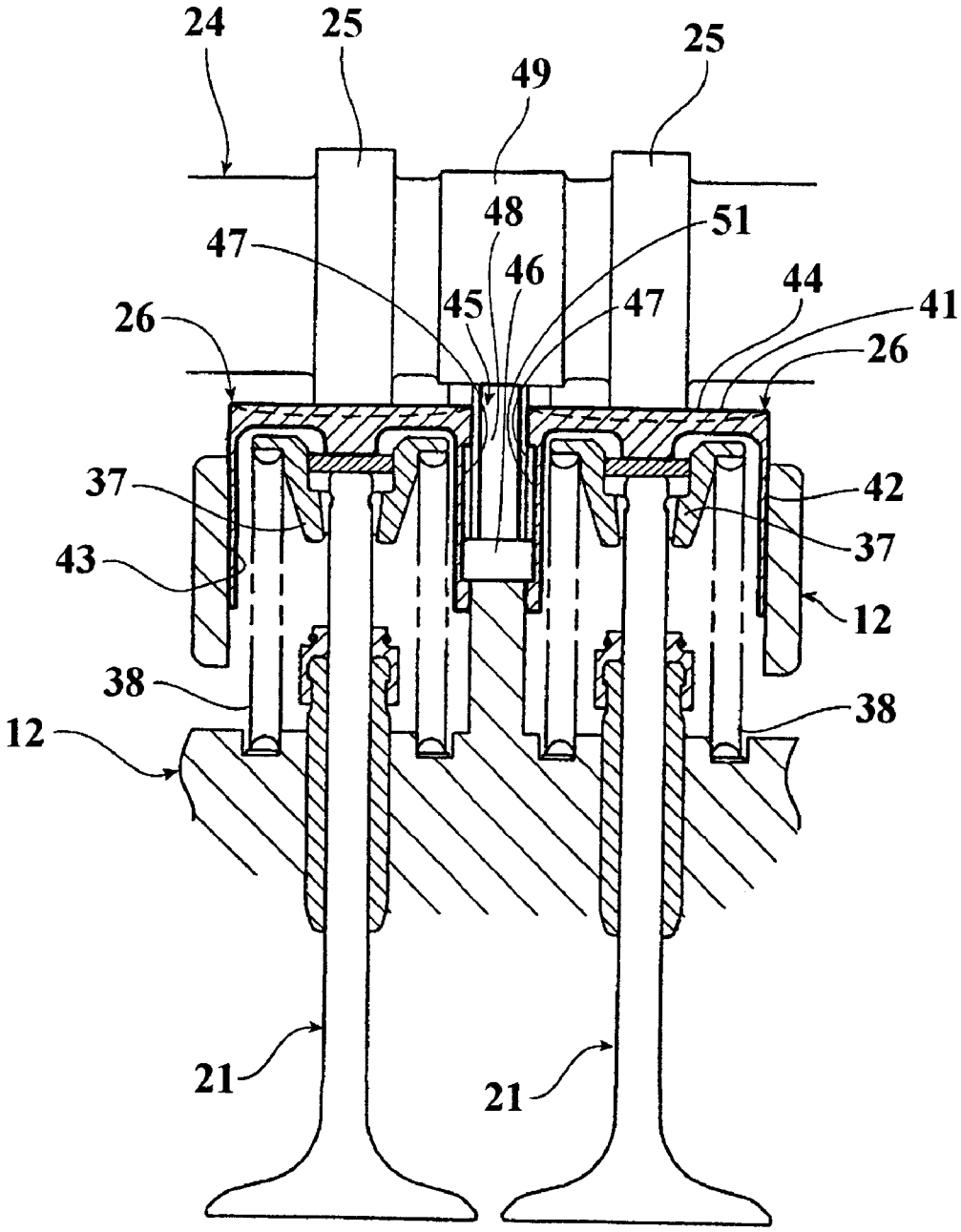
FIG. 4 is an enlarged cross sectional view taken along the line 4—4 of FIG. 3, showing the valves in their closed positions.
Figure 5:
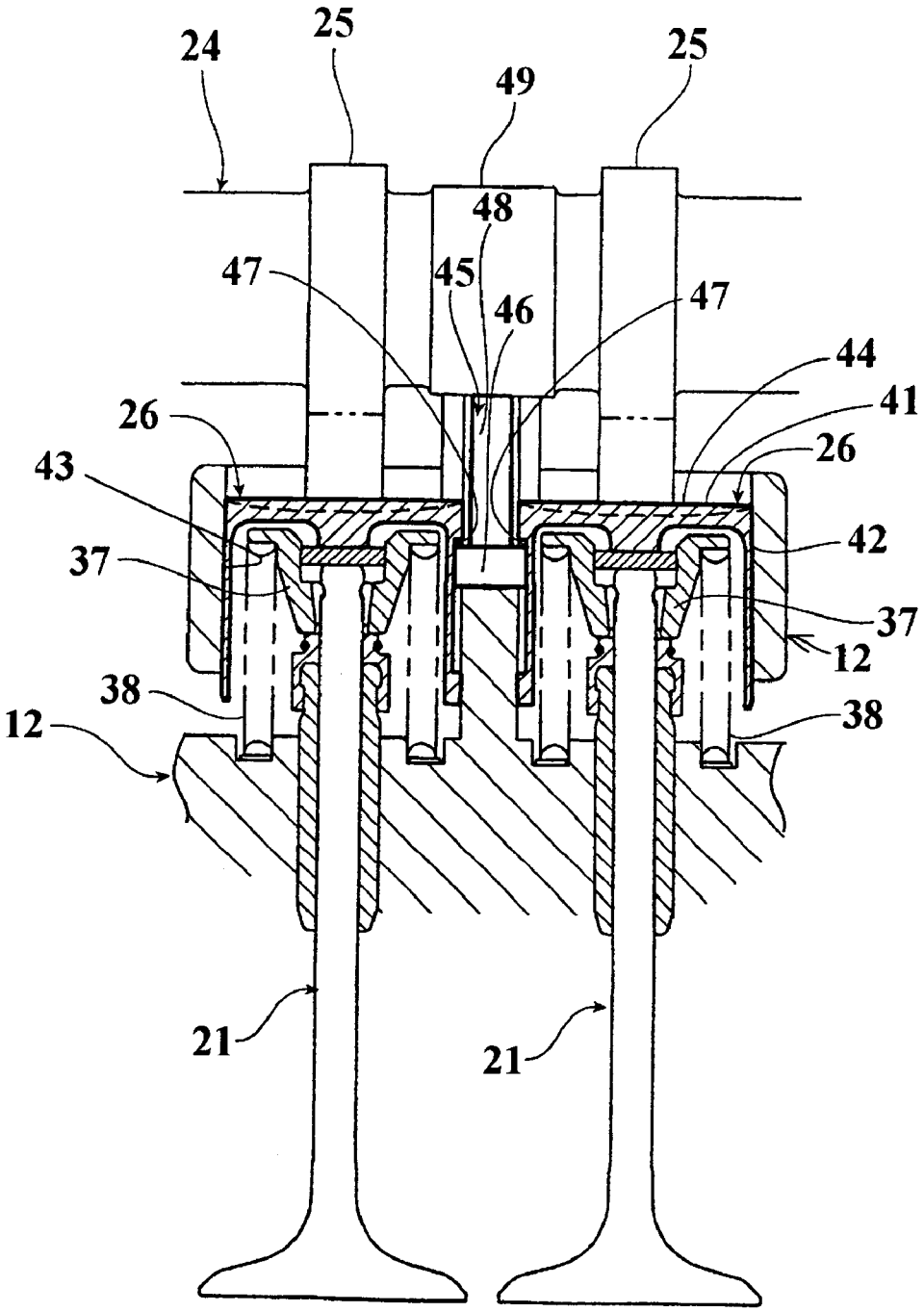
FIG. 5 is a view, in part similar to FIG. 4, but showing the actuated valves in their fully opened positions.
Figure 6:
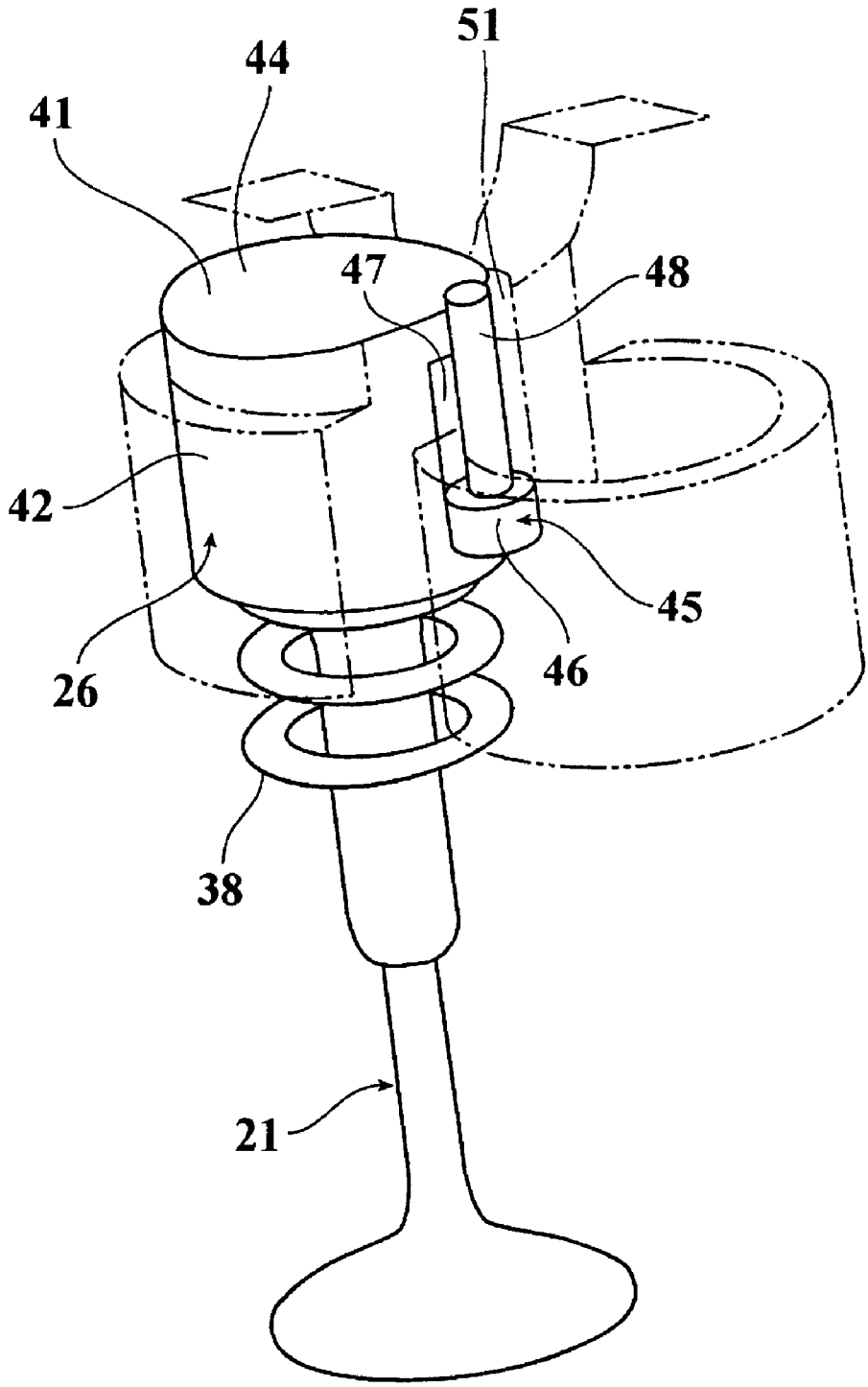
FIG. 6 is a perspective view showing one of the valve mechanism and the associated anti-rotation device when the valve is closed, with remaining components of the engine being shown in phantom.

The anti-rotation recesses 47 have an axial length such that the large diameter anti-rotation portion 46 of the pin 45 can traverse the length of the recesses 47 when the valves move between their fully closed positions as shown in FIG. 4 and their fully opened positions as shown in FIG. 5. Thus, this structure, which precludes rotation, is not provided by any added material on the tappet bodies 26 and, in fact, they are provided with a reduced weight of reciprocation because of the formation of the recesses 46 therein. Also, because of the fact that the anti-rotation pins 45 are held in place by the camshaft bearing portion 49 no significant assembly problems are presented.

The cylinder head member 12 is formed with a bore 51 that will clear the smaller diameter portions 48 as well as the headed portions 46 of the pins 45 so as to facilitate assembly.

Figure 7:
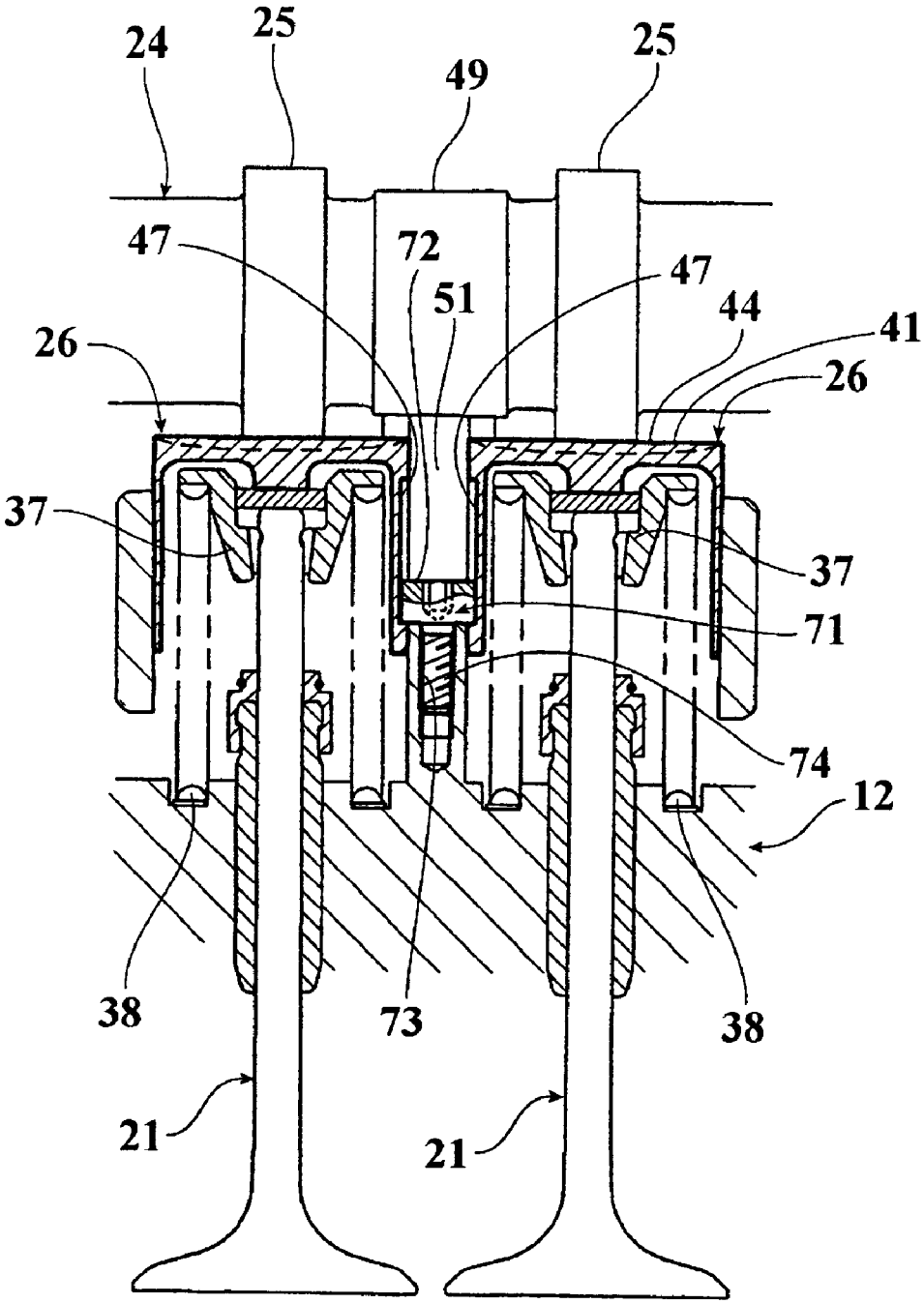
FIG. 7 is a cross sectional view, in part similar to FIG. 4, but shows another embodiment of the invention, with the valves in their closed positions.
Figure 8:
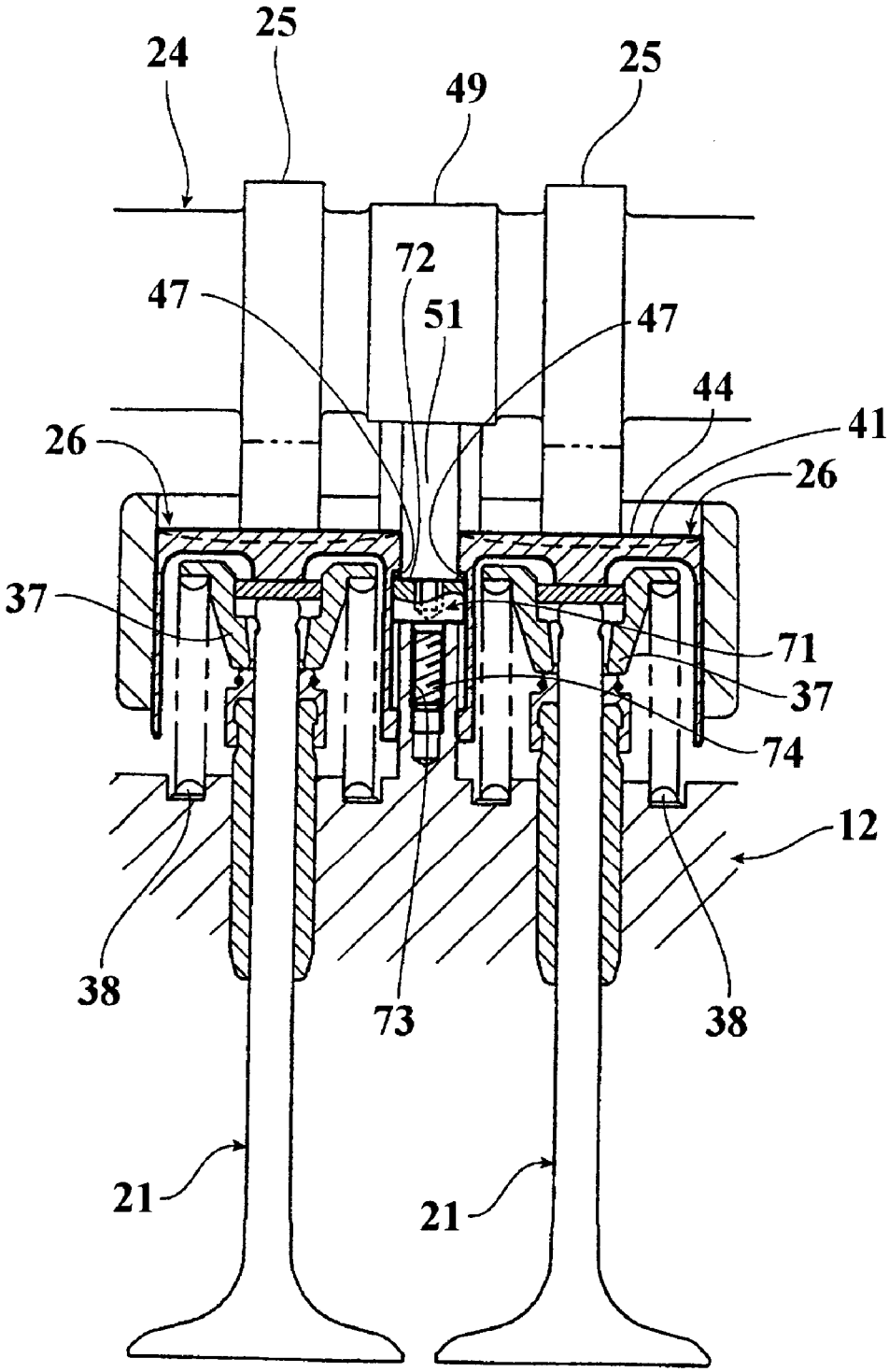
FIG. 8 is a cross sectional view, in part similar to FIG. 5, but showing the valves of this embodiments in their fully opened positions.

FIGS. 7 and 8 show another embodiment of the invention. This embodiment differs from that already described only in the construction and mounting of the anti-rotation locking pin. Therefore only two figures corresponding to FIGS. 4 and 5 of the previously described embodiment are believed to be sufficient to permit those skilled in the art to practice this embodiment. In these figures any components that are the same or substantially the same as the components already described have been identified by the same reference numerals. These components will be discussed further only in so far as is necessary to understand the construction and operation of this embodiment.

In this embodiment, rather than relying on the camshaft bearing surface 49 for holding the any-rotation device in position, a screw threaded connection is utilized between the anti-rotation locking pin, indicated generally by the reference numeral 71 in these figures. This locking pin 71 has a socket headed portion 72 which is sized so as to fit within the cylinder head bore 51 and permitted to be screwed into a tapped opening 73 formed in the cylinder head assembly 12. A threaded portion 74 is formed below the socket head 72 for permitting this connection.

The socket head 72 is sized so as to fit into the recesses 46 of the tappet bodies 26. As may be seen in FIG. 8, the head 72 is mounted in the cylinder head assembly 12 in a position so that it will cooperate with the tappet slots 47 through the full length of movement of the valves 21 between their opened and closed positions shown respectively in FIGS. 8 and 7.

In all other regards, this embodiment is the same, as that previously described and further description of it is not believed to be necessary to permit those skilled in the art to practice the invention.

In the embodiments as already described, the construction has been employed with four valve per cylinder engines and one anti-rotation pin either 45, 71 has been employed between two paired valves serving a single cylinder. Although this has the advantage of simplicity, it provides some lack of freedom in where the anti-rotation device may be located around the body of the tappet 26.

Figure 9:
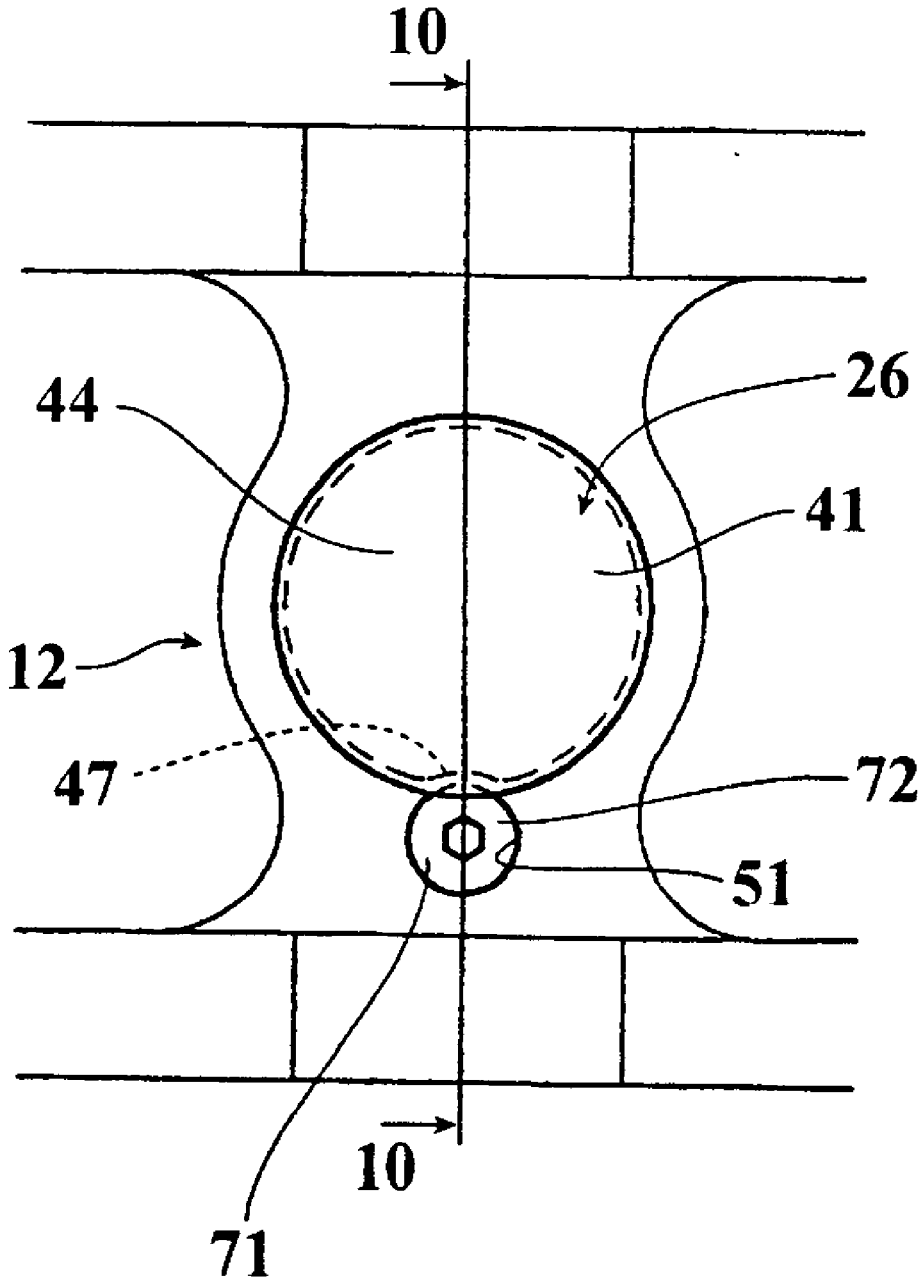
FIG. 9 is a top plan view, in part similar to FIG. 3, and shows a still further embodiment of the invention.
Figure 10:
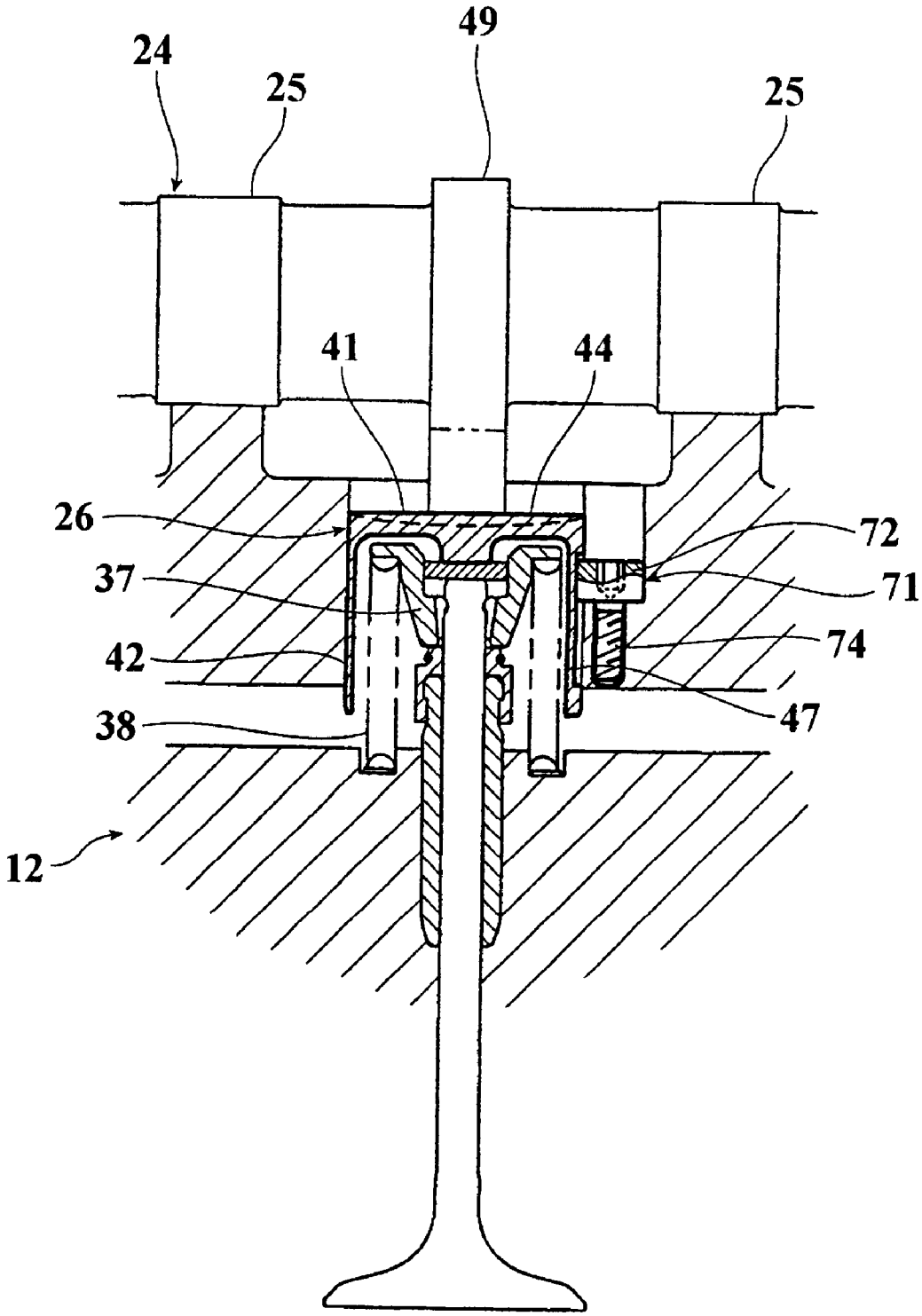
FIG. 10 is a cross sectional view taken along the line 10—10 of FIG. 9 and with the valve fully opened.

FIGS. 9 and 10 show another construction that utilizes a locking pin that is threaded into the cylinder head, like that of the embodiment of FIGS. 7 and 8. Therefore, the locking pin and its parts in this embodiment are identified by the same reference numerals. In addition, the same references numerals have been utilized to identify the components already described and they will not be described again.

As may be seen, this embodiment shows the positioning of the anti-rotation pin 71 at a side of the tappet 26 that does not lie on the axis of rotation of the camshaft. Of course, other circumferential locations can be employed as should be readily apparent to those skilled in the art.

Thus, from the foregoing description it should be readily apparent that the described constructions provide a very good and simple arrangement for preventing rotation of the valve actuating tappets or lifters around their reciprocal axis due to the action of the cam lobes against the tappet faces. Of course, the foregoing description is that of preferred embodiments of the invention and various changes and modifications may be made without departing from the spirit and scope of the invention, as defined by the appended claims.

What is claimed is:

1. A valve lifter arrangement for operating a poppet valve from the rotating cam of a cam shaft comprising an engine body defining a cylindrical bore, a valve tappet having a generally cylindrical body portion supported for reciprocation in said cylindrical bore and a head portion adapted to be operated by the cam, an axially extending cylindrical groove formed in a side of said tappet body and a pin having an axis extending parallel to said cylindrical bore with a larger diameter portion complimentary to said cylindrical groove and received therein and a smaller diameter portion affixed relative to said engine body to permit reciprocation of said valve tappet in said engine body and prevent rotation thereof.

2. A valve lifter arrangement as set forth in claim 1 wherein the pin is detachably carried by the engine body.

3. A valve lifter arrangement as set forth in claim 2 further including an arrangement for axially restraining the pin in the engine body.

4. A valve lifter arrangement as set forth in claim 3 wherein the cylindrical pin is axially restrained in the engine body by a threaded connection.

5. A valve lifter arrangement as set forth in claim 1 wherein there are two adjacent valve lifters each operating a respective poppet valve and supported in a respective engine body cylindrical bore, each of said valve lifters having facing complimentary receiving grooves cooperating with opposite sides of a common pin.

6. A valve lifter arrangement as set forth in claim 5 wherein the pin is detachably carried by the engine body.

7. A valve lifter arrangement as set forth in claim 6 further including an arrangement for axially restraining the pin in the engine body.

8. A valve lifter arrangement as set forth in claim 7 wherein the pin is axially restrained in the engine body by a bearing surface of the camshaft positioned between a pair of cam lobes, each of which cooperates with a respective valve lifter.

9. A valve lifter arrangement as set forth in claim 7 wherein the cylindrical pin is axially restrained in the engine body by a threaded connection.

10. A valve lifter arrangement for operating a poppet valve from the rotating cam of a camshaft comprising an engine body defining a cylindrical bore, a valve tappet having a generally cylindrical body portion supported for reciprocation in said cylindrical bore and a head portion adapted to be operated by the cam, interengaging portions comprising a cylindrical projection comprising a cylindrical pin having an axis parallel to the axis of said engine body cylindrical bore detacheably carried by said engine body and a complimentary receiving groove carried by said valve tappet to permit reciprocation of said valve tappet in said engine body and prevent rotation thereof said cylindrical pin being axially restrained in said engine body by a bearing surface of said camshaft.

11. A valve lifter arrangement as set forth in claim 10 wherein the cylindrical pin has a smaller diameter portion extending in a spaced radial position from the valve tappet head portion and a larger diameter portion received in the complimentary receiving groove.

12. A valve lifter arrangement as set forth in claim 11 wherein the cylindrical projection is detachably carried by the engine body.

13. A valve lifter arrangement as set forth in claim 10 wherein the cylindrical pin is axially restrained in the engine body by a bearing surface of the camshaft.

* * * * *